United States Patent [19]

Baldi

[11] 4,234,264

[45] Nov. 18, 1980

[54] MULTI-DIRECTIONAL MARKING DEVICE OF THE TYPE TO BE USED ON PAVEMENT SURFACES

[76] Inventor: Michael O. Baldi, 120 Sumner St., Newton Centre, Mass. 02159

[21] Appl. No.: 342

[22] Filed: Jan. 2, 1979

[51] Int. Cl.[3] ..... E01F 9/00

[52] U.S. Cl. ..... 404/11; 404/16

[58] Field of Search ..... 404/11, 9, 15, 16, 10

[56] References Cited

U.S. PATENT DOCUMENTS

| | | | |
|---|---|---|---|
| 1,174,368 | 3/1916 | Walsh | 404/11 X |
| 1,599,986 | 9/1926 | Chapel | 404/11 |
| 1,797,498 | 3/1931 | Finley | 404/11 |
| 2,073,968 | 3/1937 | Krebs | 404/11 |
| 2,157,059 | 5/1939 | Rosener | 404/11 |
| 2,224,937 | 12/1940 | Stedman | 404/11 |
| 3,216,335 | 11/1965 | Stolarczyk | 404/11 |

FOREIGN PATENT DOCUMENTS

| | | | |
|---|---|---|---|
| 216369 | 7/1958 | Australia | 404/11 |
| 701887 | 1/1941 | Fed. Rep. of Germany | 404/11 |
| 1164452 | 3/1964 | Fed. Rep. of Germany | 404/11 |

*Primary Examiner*—Nile C. Byers, Jr.

[57] ABSTRACT

This is a pavement marking device that is incorporated into pavement structures, more specifically into pavements subject to abuse from snow removal or snow clearing apparatus, and on pavements where vehicles travel in one direction or in multiple directions and where the aforementioned pavements may be frequented by vehicles during periods of darkness, and when such vehicles possess the capability to illuminate their respective direction of travel this device will effectively mark their respective positions with regard to the pavement, thereby acting as a medium to guide said vehicles through their course of travel.

4 Claims, 7 Drawing Figures

MULTI-DIRECTIONAL MARKING DEVICE OF THE TYPE TO BE USED ON PAVEMENT SURFACES

BACKGROUND OF THE INVENTION

1. Field of the Invention

The present invention relates to pavement marking devices and more specifically to semi-collapsible pavement marking devices whose respective marking part(s) move away from the force created by an object which may come into contact with the device.

2. History of the Prior Art

Conventional pavement marking devices utilized in warm climates, which are subjected to snow or ice conditions, are rigid and are secured and protrude above the pavement surface, when they are subjected to the scraping action of snow clearing equipment they are inevitably destroyed. Those conventional marking devices utilized in cold climates, which are subject to snow or ice conditions, have a base which is installed in such a manner that the upper plane of the base is, for the most part, flush with the surface of the pavement. A reflective surface is mounted upon a reciprocating stem which is anchored to, or is slidably mounted in, the base which allows the stem to protrude above the base and therefore above the pavement surface. The anchored stem type allows the stem, should it be struck, to move away from the force acting upon it. However when snow packs or ice forms around and about the device it renders it a rigid body and prevents the stem from moving away from the source of impact, ultimately leading to the destruction and failing of the device due to the overwhelming forces acting upon it. While the above shortcomings are also true for the type which incorporate a slideably mounted stem, the slideably mounted type has yet another shortcoming because the stem is designed to move only in a vertical direction, the stem can only readily react under a load that is acting directly downwards upon it, and such is not the case with regard to a snowplow blade which exerts a force upon the side of the stem and which, when traveling at normal highway speeds, intercepts and passes by the device in approximately one-thousandth of a second, during which time the device cannot respond quickly enough to prevent undue stress from developing within the device, which ultimately leads to its destruction. Another shortcoming both types of marking devices have in common is that all allow for a space to exist within the exterior of the device for the reciprocation of the stem, which in itself makes the device prone to contamination from road debris or from the natural elements and such contamination could lead to the failing of the device.

Another shortcoming of the stem type road marker becomes apparent should the stem suffer damage for it cannot be easily repaired since it is, for the most part, an integral component of the device as a whole.

The present invention is designed to eliminate these troublesome problems by offering a practical device of simple construction which is efficient and durable for marking the various lanes used for vehicular travel.

The following patents are known to Applicant and illustrate the above prior art: U.S. Pat. Nos.

1,777,585
1,888,447
2,224,937

3,502,008
2,073,968
4,049,358
2,127,700
2,157,059

SUMMARY

It is an object of my pavement marking device that when properly installed, the base of the device is virtually indestructible because it does not come in contact with destructive forces.

A further object of my invention is for a resilient sphere to collapse inwardly so that no snow or ice can adhere to it when struck by a vehicle or projection thereof. The reflective body and/or resilient sphere nullifies the force of impact because the resilient sphere is able to rotate within the base, and, both are allowed to move downward into the partial spherical socket below the uppermost plane of the base and therefore below the surface of the pavement and therefore out of harms way. The portion of the resilient sphere which extends upward beyond the uppermost plane of the base can be struck from any direction and the device will not succumb to damage. The resilient sphere can be provided hollow and such that it admits light which activates the reflective properties of the reflective surface(s) contained within the hollow portion of the resilient sphere.

An optional magnet can be provided upon the reflective body contained within the aforementioned hollow resilient sphere that will function as a weight and counterweight which will right the reflective body, while the interaction of the magnet housed upon the base with the reflective body magnet, by the intrinsic characteristics peculiar to magnets such that north polarity attracts south polarity and north polarity repels north polarity, will cause the reflective body to align itself with regard to the magnetic polarity which will then maintain the reflective body in a consistent position preferably such that the reflective means are perpendicular to the vehicular direction of travel. It is a further object of my invention to prevent foreign matter from affecting my device. The snug fit between the partial spherical socket wall and the outside limits of the resilient sphere prevents any liquid or foreign material from entering the partial spherical socket, thereby preventing any damage to the device by the elements.

Because there is a distinct front position of the device in one of its various forms and when relying on the intrinsic characteristics of magnets, then each reflective surface incorporated upon the reflective body can be of a different color(s) independently of the other such that each may independently symbolize a certain traffic call signal and such that each will consistently face in the proper direction. The device can be installed upon inclines without sacrificing any of its aforementioned characteristics.

Now due to the fact that the circular opening in the uppermost plane of the base has a diameter less than that of the largest diameter of the resilient sphere taken about its widest horizontal section, the widest horizontal section being located below the uppermost plane of the base, the resilient sphere is therefore locked into the partial spherical socket, therefore the base, and will not come out of the partial spherical socket under ordinary use conditions.

The resilient sphere, should it be in need of repair or should a change be desired, can be readily removed from the partial spherical socket, without disturbing the base, by providing a means which will pull the resilient sphere straight upwards. Should it become necessary to replace the type of resilient sphere which contains an isolated body within it, then the resilient sphere can be readily removed from the partial spherical socket and the isolated body within the sphere can be salvaged and recycled.

Because the needs of each individual user may vary as to the application of the device, a number of different and interchangeable spheres, each having a different characteristic(s) and/or trait(s), can be made available and readily put to use with ease.

BRIEF DESCRIPTION OF THE DRAWINGS

FIG. 8 illustrates a side view of a further contrivance of the device of this invention.

FIG. 9 illustrates a cross-sectional view of the further contrivance of the device of this invention.

DESCRIPTION OF THE PREFERRED EMBODIMENTS

With reference to the accompanying illustrations FIGS. 1-7 illustrate a preferred embodiment of the device.

Figure 1:
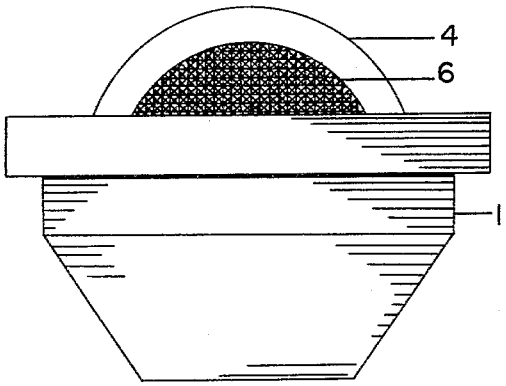
FIG. 1 illustrates a front view of the device of this invention.

FIG. 1 illustrates a front or back view showing base (1), the top of the transparent resilient sphere (4) which in this case is hollow, and a front or back view of the upper section of the reflective body (5) which is contained within resilient hollow sphere (4). The entire device is shown in its normal state of rest.

Figure 2:
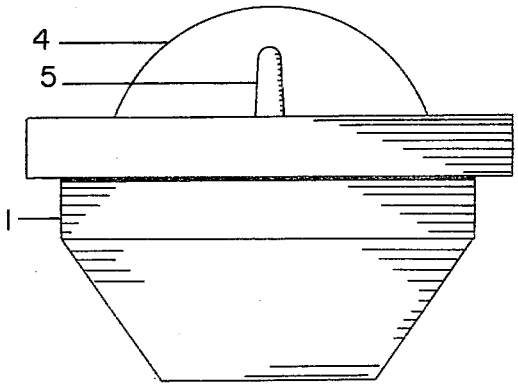
FIG. 2 illustrates a side view of the device of this invention.

FIG. 2 is a side view showing the base (1), the top portion of the transparent resilient hollow sphere (4) and a side view of the upper section of the reflective body (5) which is contained within the transparent resilient hollow sphere (4). The entire device is shown in its normal state of rest.

Figure 3:
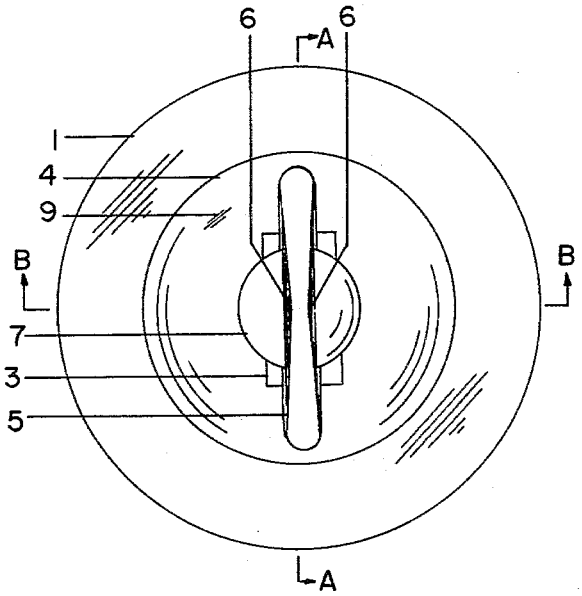
FIG. 3 illustrates a top view of the device of this invention.

FIG. 3 is a top view showing base (1), the top portion of the transparent resilient hollow sphere (4), the base magnet (3), flotation bulb (7) which is positioned upon the reflective body (5), the reflective plates (6) and the surface of the fluid (9) which partially fills the interior of the transparent resilient hollow sphere (4). The entire device is shown in its normal state of rest.

Figure 4:
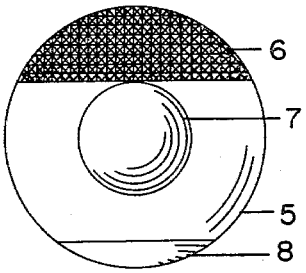
FIG. 4 illustrates a front view of the reflective body.

FIG. 4 is a front and/or back view of the reflective body (5) showing the relationship of the positions of the reflective plate(s) (6), the magnet (8) and flotation bulb (7).

Figure 5:
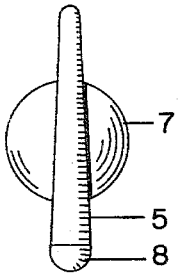
FIG. 5 illustrates a side view of the reflective body.

FIG. 5 is a side view of the reflective body (5) showing the flotation bulb (7) and the magnet (8).

Figure 6:
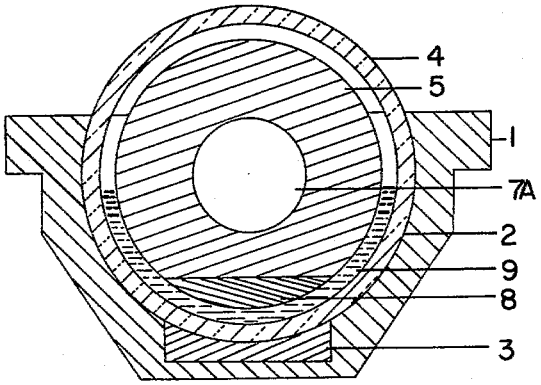
FIG. 6 illustrates a cross-sectional view through A—A of FIG. 3.

FIG. 6 is a cross-sectional front and/or back view of the device taken at section A—A of FIG. 3 showing base (1) and the various components when the device is at rest, the components consisting of the reflective body (5) afloat in the fluid (9) and the position of the magnet (8) above the base magnet (3), all being contained within the transparent resilient hollow sphere (4) which is positioned within the partial spherical socket (2).

Figure 7:
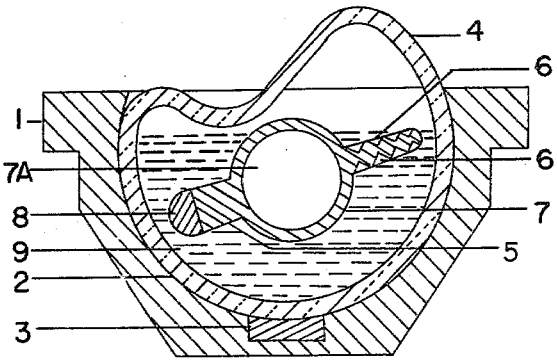
FIG. 7 illustrates a cross-sectional view through B—B of FIG. 3 with resilientsphere in a deformed state.

FIG. 7 is a cross-sectional view taken at section B—B of FIG. 3 showing the base (1) and the positions of the various components as they interact with each other under impact conditions. Upon impact the transparent resilient hollow sphere (4) collapses inwardly making contact with the reflective body (5) which causes the magnetic attraction between the base magnet (3) and the magnet (8) to be broken leaving the reflective body (5) free to move away from the source of impact by moving downward into the fluid (9) and therefore below the uppermost plane of the base (1) while the transparent resilient hollow sphere (4), should the forces acting upon it become excessive, is still free to rotate within the partial spherical socket (2), this action nullifies the excessive forces acting upon the device until such time as the object creating the impact conditions passes by, at which time the transparent resilient hollow sphere (4) resumes its spherical shape and the reflective body (5), utilizing the intrinsic characteristics of the magnet (8) and the base magnet (3), rights and aligns itself.

FIG. 8 is a side view of the device showing the reflective resilient sphere (12) in a normal state within the base (1A).

FIG. 9 is a partial cross-sectional view of the device taken about axis c—c of FIG. 8 showing the reflective resilient sphere (12), which is totally comprised of common cube reflective prisms (14), and the apex's of said common cube reflective prisms (15), housed within the partial spherical socket (2A) of the resilient absorber (11) which in turn is housed in the socket (10) of the base (1A), said resilient absorber (11) being utilized within the device as a compensating means for the expansion and contraction of the reflective resilient sphere (12) during the extremes of heat and the extremes of cold to which the device may be subjected and which, therefore, keeps the reflective resilient sphere (12) within the device firmly seated. form, the partial spherical socket (2) and a resilient insert (11) that is shaped to fit into the base (1A) and shaped on its interior to receive a resilient sphere such as the resilient sphere (10) where the resilient insert (11) is used as a compensating means for the expansion and contraction of a resilient sphere during the extremes of heat and the extremes of cold to which the device may be subjected and which, therefore, keeps the resilient sphere firmly within the device.

As illustrated in FIGS. 1 through 7 and in one of its various forms, the invention is provided with a base (1) which is placed into a hole in the pavement structure, said hole having the same outside dimensions as the outside limits of the base (1) so that the base (1) will fit snugly into the hole. When the base (1) is properly installed in the pavement structure the uppermost plane of the base (1) is flush with the surface of the pavement structure. Base (1) is provided with a spherically shaped socket (2) having as its centerpoint a point which is strategically located below the uppermost plane of the base (1) and located in such a manner so as to ensure that a line extending a fixed distance in any direction from the centerpoint of the partial spherical socket (2), falls within the bounds established by the extreme outer limits of the base (1) within the area situated below the uppermost plane of the base (1) but which does extend beyond the uppermost plane of the base (1) thereby creating a circular opening in the uppermost plane of the base (1) whose respective diameter is less than the diameter of the partial spherical socket (2) taken at its widest horizontal sectional plane which, of course, is below the uppermost plane of the base (1). Incorporated into the bottommost part of the partial spherical socket (2) is base magnet (3) situated in base (1) such that when base (1) is secured in the pavement structure the north-/south polarity axis of the base magnet (3) is consistently in some specific location with regard to the direction of vehicular travel upon the pavement structure.

A transparent resilient hollow sphere (4) has the same common centerpoint as the aforementioned partial spherical socket (2) and fits snugly into the partial spherical socket (2) in such a manner so as to afford a good seal between the wall of the partial spherical socket (2) and the extreme outer limits of the transparent resilient hollow sphere (4) which protrudes above the uppermost plane of the base (1) is provided with an isolated reflective body (5) within it.

Said isolated reflective body (5) is provided with a magnet (8) secured by a member to the reflective body (5) upon or near the perimeter of the reflective body (5) so as to act as a weight and counterweight with regard to the reflective body (5) so that when the reflective body (5) is set afloat in the fluid (9), which respectively partially fills the inner chamber of the transparent resilient hollow sphere (4), the magnet (8) will be in the bottommost position with regard to the reflective body (5). Therefore, located at the topmost position of the reflective body (5) and situated upon the reflective plates (6) which face in multiple directions.

The reflective body (5) is provided with flotation means such as the flotation bulb (7) and its respective air cavity (7A) which renders it positively bouyant and therefore, when placed in the fluid (9) the reflective body (5) will float in a frictionless environment provided it by the fluid (9). The dimensions of the reflective body (5) should be such that when the reflective body (5) is made to lie in a horizontal position within the inner chamber of the transparent resilient hollow sphere (4), no part of the reflective body (5) is allowed to extend any further upward than the uppermost plane of the base (1). Simultaneously the perimeter of the reflective body (5) will not come into contact with the interior wall of the transparent resilient hollow sphere (4). When the reflective body (5) is allowed to assume a position whereby the magnet (8) upon the reflective body (5) is in the bottommost position with regard to the reflective body (5), the magnet (8) is within the magnetic field range of the base magnet (3) which will therefore cause the reflective plates (6) to be positioned above the uppermost plane of the base (1), and therefore above the pavement surface. Magnet (8) is positioned upon the reflective body (5) in such a manner that when the interaction between the base magnet (3) and the magnet (8) occurs, the north to such polarity axis of the magnet (8) will seek the south to north polarity axis of base magnet (3) and reflective plates (6) will therefore be correctly positioned such that they are preferably perpendicular to the vehicular direction of travel.

Although the present invention has been described with reference to particular embodiments, it will be apparent to those skilled in the art that variations and modifications can be substituted therefore without departing from the principles and spirit of the invention.

I claim:

1. An improved road marker of the type usually fastened into apertures defined in road pavement surfaces where the improvement comprises:

a base, adapted to fit within said aperture in said road pavement having defined therein an open-topped spherical aperture; and a deformable resilient sphere conincidentally retained in said open topped spherical aperture, having a portion thereof protruding above said base and said road pavement surface; and wherein said resilient sphere is free and able to universally rotate in said open-topped spherical aperture; and wherein said sphere is hollow and includes independent means for reflecting light wherein said means used for the purpose of reflecting light entering said sphere, back outside said sphere, is positioned within said sphere and said sphere is light transmittable thereby allowing light to freely enter said sphere through the wall of said sphere and said means for reflecting light has the capacity to be independently displaced when said sphere is deformed and therefore said means for reflecting light is protected from damage.

2. The device of claim 1 wherein said resilient sphere includes a fluid located in said sphere and said means for reflecting light has means to float in said fluid.

3. The device of claim 1 and claim 2 wherein an attracting magnet is positioned in said base and a corresponding magnetical means is provided and housed upon said means for reflecting light so that when said means for reflecting light is displaced, the magnet and corresponding magnetical means will. after the displacement is over, cause realignment of the means for reflecting light in said sphere.

4. An improved road marker of the type usually fastened into apertures defined in road pavement surfaces where the improvement comprises:

a base, adapted to fit within said aperture in said road pavement having defined therein an open-topped aperture; having therein affixed a compressible resilient element which is flush with the top of the base and which has defined therein an open-topped spherical aperture; and a deformable resilient sphere adapted to be coincidentally retained in said open-topped spherical aperture, having a portion thereof protruding above said base and said road pavement surface; and wherein said resilient sphere is free and able to universally rotate in said open-topped spherical aperture; and wherein said sphere is comprised and formed of a continuous pattern of common corner cube type reflective elements which therefore renders said sphere to be totally and universally reflective throughout the entire surface parameters of said sphere.

* * * * *